US006581392B1

(12) United States Patent
Gist et al.

(10) Patent No.: US 6,581,392 B1
(45) Date of Patent: Jun. 24, 2003

(54) ICE MACHINE AND METHOD FOR CONTROL THEREOF

(75) Inventors: David Brett Gist, Grayslake, IL (US); Matthew Allison, Mundelein, IL (US); Andy Pichotta, Montgomery, MN (US); Chris J. Teal, Round Lake, IL (US); Tim Bethuy, New Fairfield, CT (US)

(73) Assignee: Scotsman Ice Systems, Vernon Hills, IL (US)

( * ) Notice: Subject to any disclaimer, the term of this patent is extended or adjusted under 35 U.S.C. 154(b) by 0 days.

(21) Appl. No.: 10/061,952

(22) Filed: Feb. 1, 2002

(51) Int. Cl.[7] ..... F25C 1/00

(52) U.S. Cl. ..... 62/66; 62/139

(58) Field of Search ..... 62/66, 135, 137

(56) References Cited

U.S. PATENT DOCUMENTS

| | | | | | |
|---|---|---|---|---|---|
| 4,616,485 | A | * | 10/1986 | Gillett et al. | 62/228.1 |
| 4,822,996 | A | * | 4/1989 | Lind | 250/222.1 |
| 5,560,211 | A | * | 10/1996 | Parker | 62/3.63 |
| 6,314,745 | B1 | * | 11/2001 | Janke et al. | 62/137 |
| 6,414,301 | B1 | * | 7/2002 | Borg et al. | 250/222.1 |
| 6,463,746 | B1 | * | 10/2002 | Bethuy et al. | 62/66 |

* cited by examiner

*Primary Examiner*—William E. Tapolcai
(74) *Attorney, Agent, or Firm*—Ohlandt, Greeley, Ruggiero & Perle, LLP

(57) ABSTRACT

An ice machine and method for control thereof. The method has various features including control of upload/download of software and data, control of ice cube detection of falling pieces as well as a bin full condition, logging of machine cycle counts, electrical load run times, error codes linked to accumulated run time of the ice machine, of program style and display of error codes and verification of program styles.

10 Claims, 10 Drawing Sheets

ICE MACHINE AND METHOD FOR CONTROL THEREOF

FIELD OF THE INVENTION

This invention relates to an ice machine and a method for controlling the ice machine. In particular, the method and ice machine include novel and improved ice cube detection, error code processing, controller installation, and servicing.

BACKGROUND OF THE INVENTION

Electronic controllers for ice machines are known. For example, U.S. Pat. No. 5,477,694 describes an ice machine having an electronic controller that responds to trouble events that occur during the running of the ice machine according to a diagnostic procedure. Also, U.S. Pat. No. 5,582,018 describes an ice machine and a controller that controls the ice machine to prevent slush from forming during a freeze cycle in which the ice machine forms ice on an evaporator thereof. Each of these patents discloses ice cube detection devices that are workable. However, their performance is subject to variations due to manufacturing tolerance and/or to environmental influence, e.g., mineral buildup, water drops, mist and the like.

The detection of objects by an optical device is also known. The aforementioned patents employ light sources and light detectors. Also, U.S. Pat. No. 6,265,709 discloses an optical detector and filtering procedure that uses variable sweep bands or random variations in the optical signal period to filter undesired noise. However, the optical detector performance is subject to variations in manufacturing tolerances.

There is a need for a method and an ice machine with a reliable ice cube detection procedure that is impervious to manufacturing variations and that is capable of counting ice cubes as well as detecting a bin full condition.

There is also a need for a method and an ice machine that is capable of tracking trouble event performance either remotely or in the field and of uploading and/or downloading data or program code from or to the controller of the ice machine There is also a need for a method and a universal controller that can be used in a plurality of different ice machines.

SUMMARY OF THE INVENTION

The method of the present invention controls an ice machine by developing error codes as the ice machine runs. The error codes are recorded in a log in a memory. A time of occurrence is assigned to at least one of the error codes wherein the time of occurrence is measured from the time of an installation event of the ice machine. The error codes and/or times of occurrence are retrievable.

According to one aspect of the method of the present invention, the ice machine includes a communication port and the error codes are retrievable via the communication port. According to another aspect of the present invention, at least one of the error codes is displayed. According to a feature of this aspect, the ice machine includes a plurality of display lights. The error codes are displayed as unique combinations of energized ones of the display lights. According to this aspect, the at least one error code in some embodiments is a most recent error code.

According to a further feature of the method of the present invention, the ice machine also includes a plurality of switches. The method detects the operation of one or more of the plurality of switches in a predetermined sequence. The most recent error code is then displayed. The method further detects the operation of a toggle switch and displays a second error code by energizing a second unique combination of the plurality of display lights. The two error codes are alternately displayed in response to further toggling of the toggle switch.

According to another embodiment of the method of the present invention, a controller is installable in any one of a plurality of different models of an ice machine. The method sets the controller to one of a plurality of program styles that corresponds to a selected one of the plurality of models. The selected program style is displayed to an operator for visual verification that the selected program style corresponds to the selected model of the ice machine. According to one aspect of this embodiment, the ice machine includes a plurality of display lights and the program style is displayed by energizing a combination of the plurality of lights that correspond to the program style.

According to yet another embodiment of the method of the present invention, the ice machine has an optical detector that detects ice cubes when in a field of vision thereof. The method illuminates the optical detector with a periodic optical signal. A plurality of samples of an output signal of the optical detector is provided. A difference between at least first and second ones of the samples is compared with a threshold to detect the ice cubes when falling through the field of vision. According to one aspect of this embodiment of the method, the difference is between signal samples that correspond to consecutive peaks of the periodic optical signal.

According to another aspect of this embodiment of the method, a determination is made that one of the ice cubes is passing through the field of vision if the difference penetrates the threshold a predetermined number of times during an interval of the periodic optical signal, the interval containing a plurality of cycles the optical signal.

According to another aspect of this embodiment of the method of the present invention, it is determined that a bin of the ice machine is full of ice cubes if the difference penetrates the threshold. In this embodiment, the difference is between signal samples that correspond to an adjacent peak and valley of the periodic optical signal.

Various embodiments of the ice machine of the present invention include a controller that performs operations that correspond to the method embodiments and aspects thereof.

BRIEF DESCRIPTION OF THE DRAWINGS

Other and further objects, advantages and features of the present invention will be understood by reference to the following specification in conjunction with the accompanying drawings, in which like reference characters denote like elements of structure and.

DESCRIPTION OF THE PREFERRED EMBODIMENT

Figure 1:
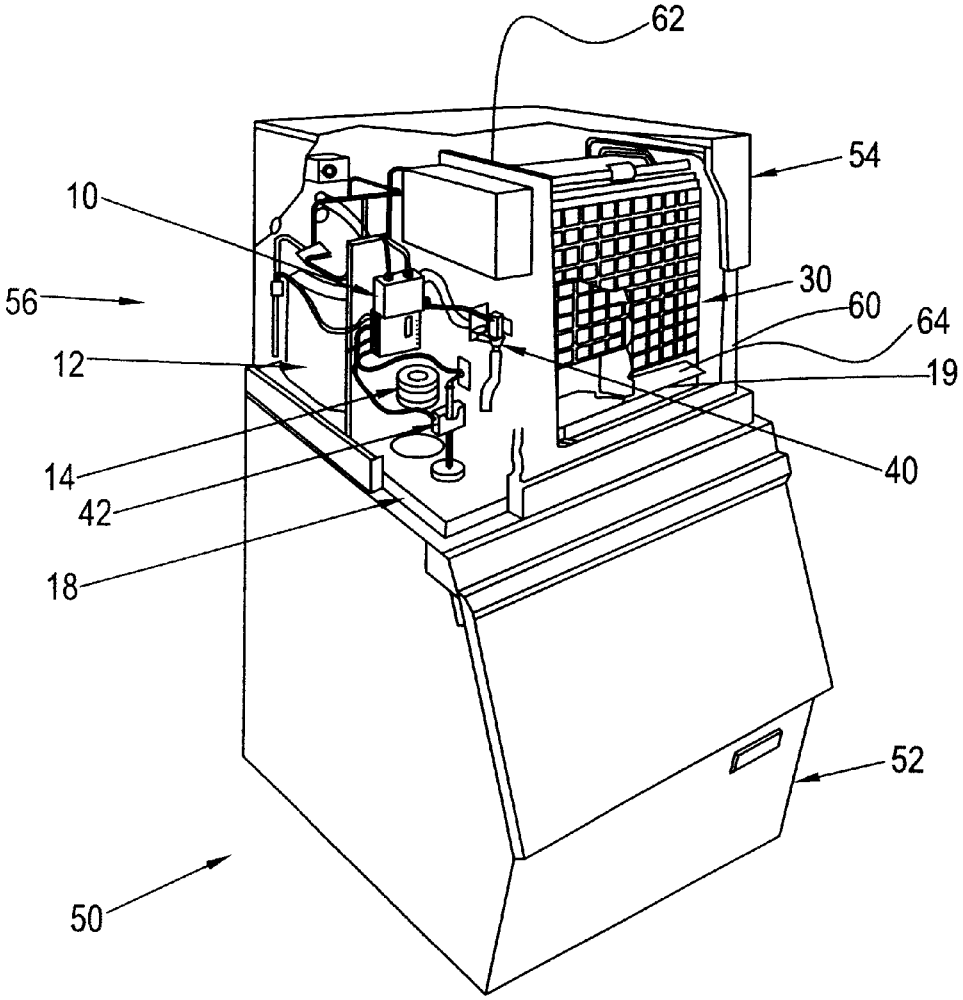
FIG. 1 is a perspective view of the ice machine of the present invention.
Figure 2:
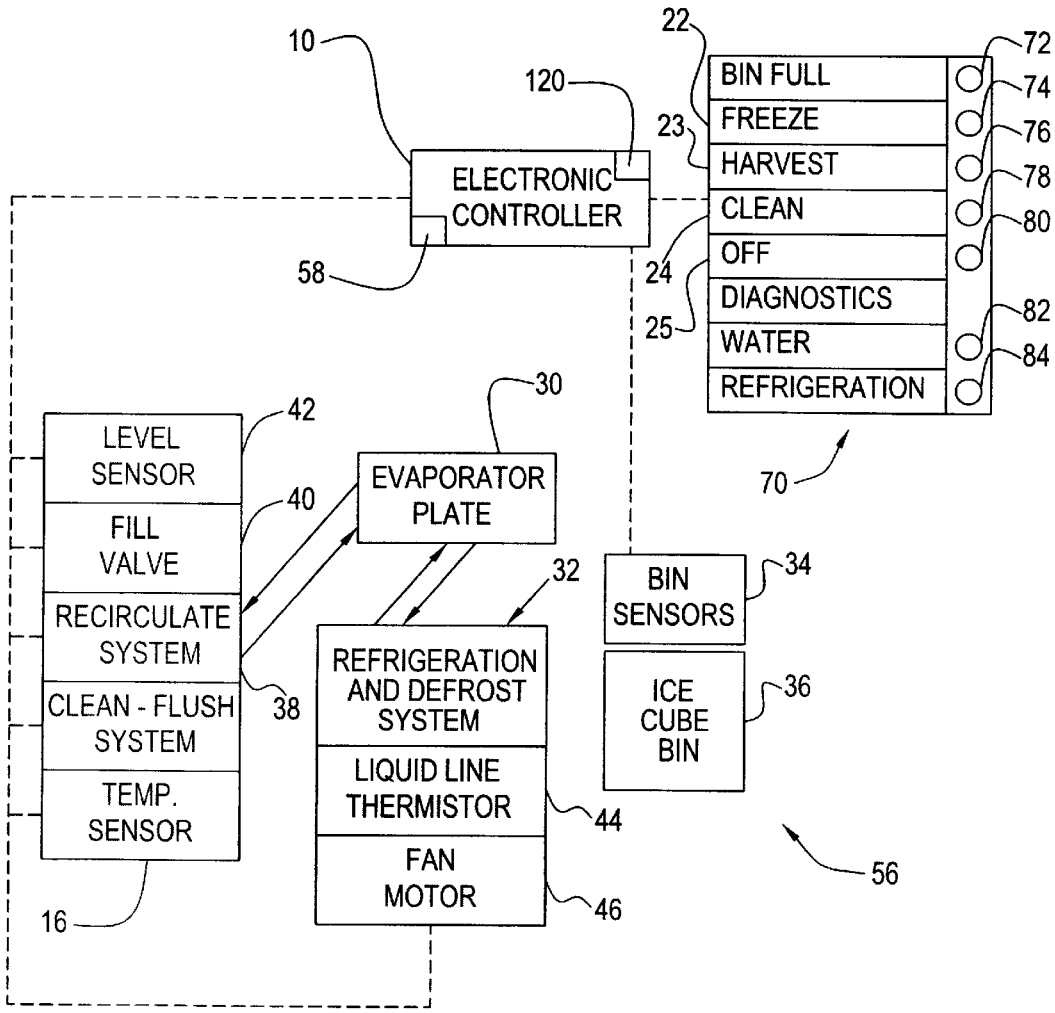
FIG. 2 is a block diagram of the electrical control of the ice machine of FIG. 1.
Figure 3:
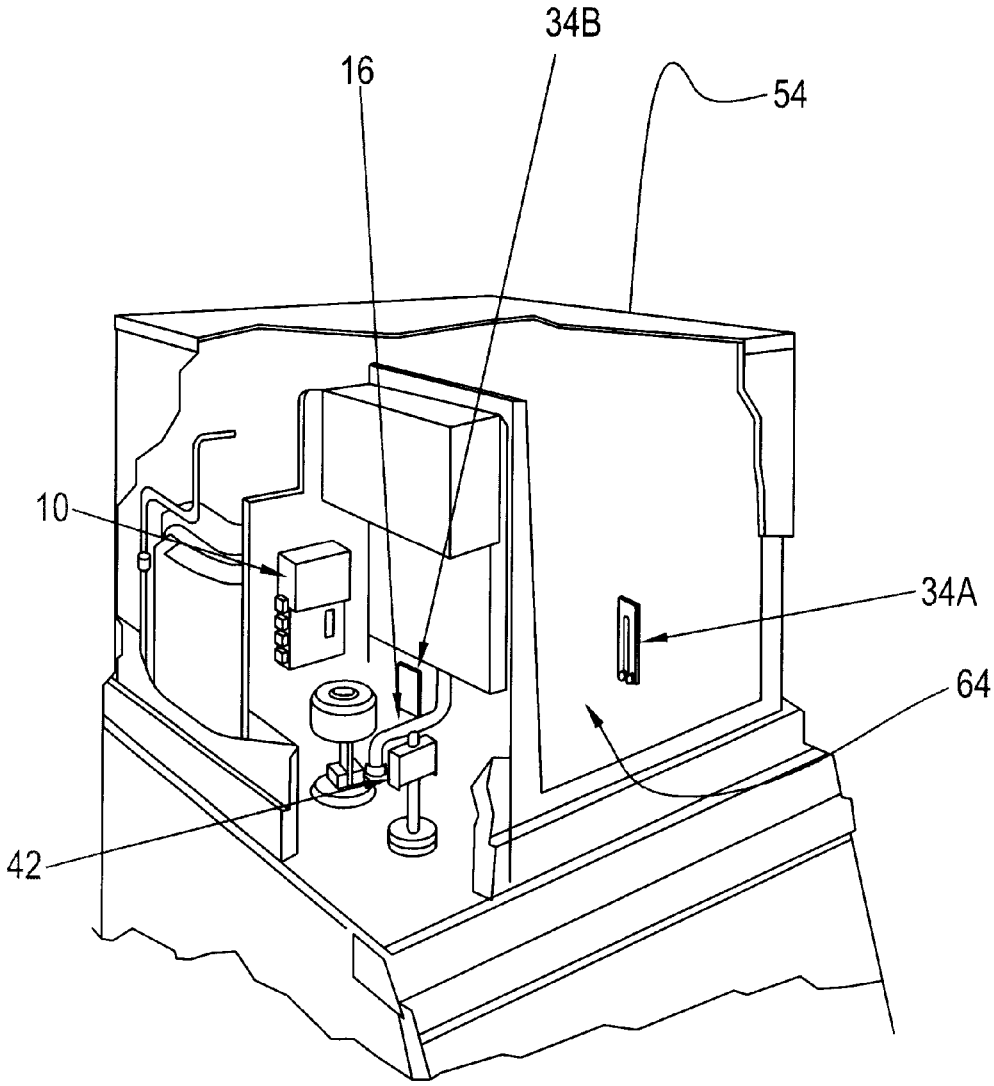
FIG. 3 is a partial perspective view of the ice machine of FIG. 1 with the evaporators removed.

Referring to FIGS. 1–3, an ice machine 50 of the present invention includes a lower housing 52 and an upper housing 54. Lower housing 52 contains an ice cube bin 36 (shown only in FIG. 2). Upper housing 54 includes an ice making system 56 of ice machine 50. Ice making system 56 includes an electronic controller 10, a compressor 12, a water pump 14, a water temperature sensor 16, a water level sensor 42, a sump 18, an ice cube deflector 19, one or more evaporator plates 30, bin sensors 34 and a water fill valve 40. Ice making system 56 also includes a condenser (not shown), a condenser fan (not shown), a hot gas valve (not shown), a liquid line thermistor 44 and a condenser fan motor 46.

Ice making system 56 further includes refrigerant tubing and valves (not shown) to connect compressor 12, the condenser, the hot gas valve and evaporators 30 in a refrigeration and defrost system 32 and water tubing (not shown) to connect water pump 30 in a water circulating system 38. Refrigeration and defrost system 32 circulates refrigerant to evaporator plates 30 that is cool during freeze cycles to make ice cubes and that is warm during harvest cycles to harvest ice cubes. Water circulating system 38 circulates water in a loop that includes water pump 14, sump 18, evaporators 30 and ice cube deflector 19. Ice cube deflector 19 includes a plurality of openings therein that permit water dripping from evaporators 30 to drain into sump 18.

Electronic controller 10 controls the complete operation of ice machine 50. Electronic controller 10 turns ice machine 50 on and off, switches it between the freeze and harvest cycles, displays information and shuts ice machine 50 down if there is a problem.

Ice making system 56 also includes a panel 70 that includes a display 70 that includes display lights 72, 74, 76, 78, 80, 82 and 84. Electronic controller 10 is operable to energize these lights in various combinations for different purposes. For example, display light 72 is energized when ice cube bin 36 is full. Display light 74 is energized during freeze. Display light 76 is energized during harvest. Display light 78 is energized curing a clean cycle. Display light 80 is energized when ice machine 50 is shut down and blinks when ice machine 50 is preparing to shut down. Display light 82 is energized when controller 10 has identified a problem with the water system. Display light 84 is energized when controller 10 has identified a problem with the refrigeration system.

Display 70 also includes manually operated buttons or switches, namely freeze button 22, harvest button 23, clean button 24 and off button 25. Manual operation of freeze button 22, harvest button 23 and clean button 24 initiate freeze, harvest and clean cycles, respectively. Manual operation of off button 24 turns controller 10 off.

Water fill valve 40 is connected to a water supply and is opened to fill sump 18 with a water charge to make a batch of ice. When water level sensor 42 indicates that there is an adequate charge of water in sump 18, electronic controller 10 closes water fill valve 40.

Water level sensor 42 also indicates when the water level in sump 18 (when the fill valve is closed and freezing cycle is activated) falls to a predetermined level. This indicates that a predetermined volume of water has been removed from sump 18 and accumulated by freezing on evaporator plates 30. When the water level in sump 18 drops to the predetermined level, electronic controller 10 discontinues the freeze cycle and initiates the harvest cycle.

Figure 4:
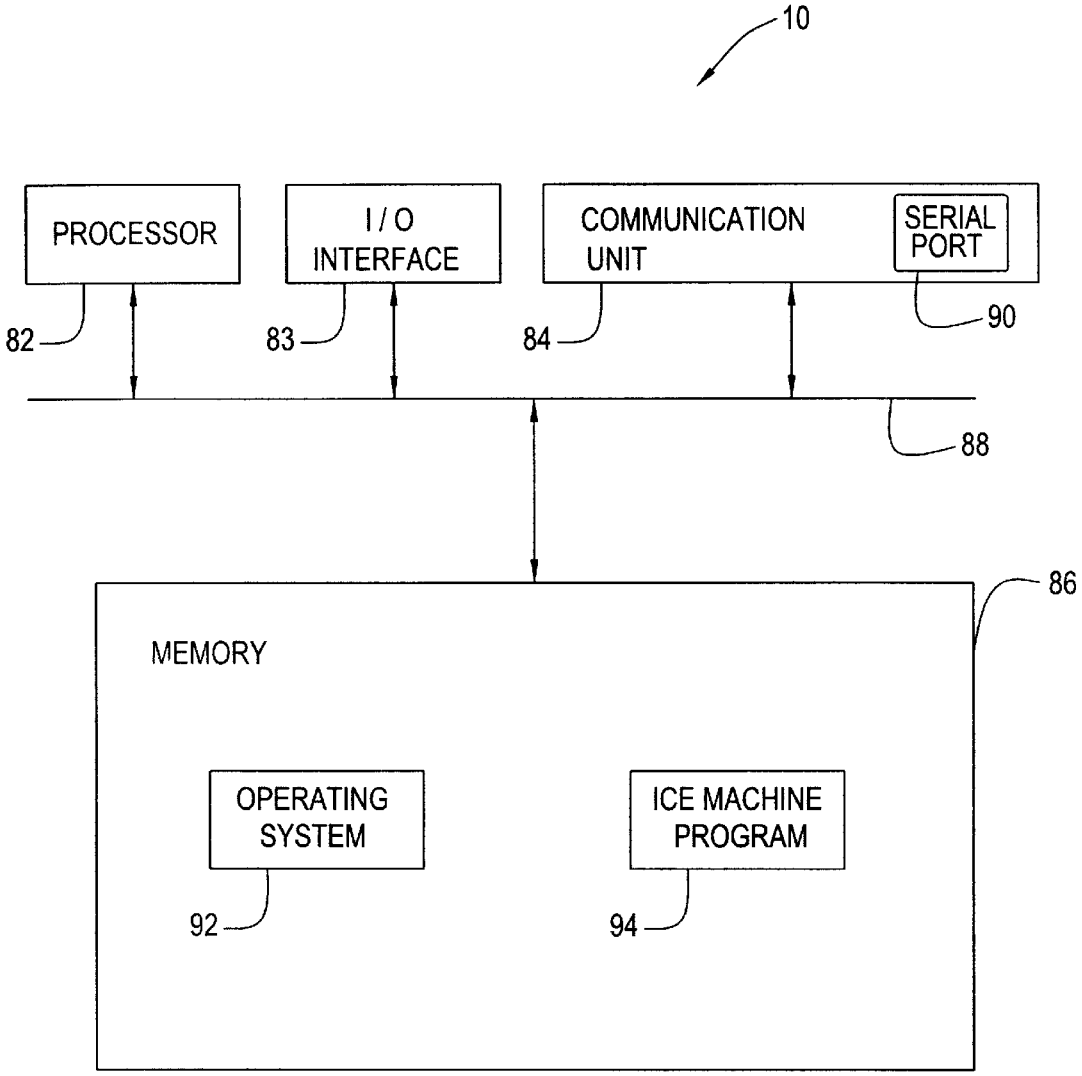
FIG. 4 is a block diagram of electronic controller of the ice machine of FIG. 1.

Referring to FIG. 4, electronic controller 10 includes a processor 82, an input/output (I/O) interface 83, a communication unit 84, and a memory 86 that are all interconnected by a bus 88. Communication unit 84 includes a serial port 90. An operating system 92 and an ice machine program 94 are stored in memory 86. Processor 82 under the control of operating system 92 executes ice machine program 94 to control ice machine 50 to perform various operating cycles including freeze and harvest. This control is effected via signals supplied to ice machine 50 via I/O interface 83 and signals received from ice machine 50 via I/O interface 83. Program 94 also includes the features of the method of the present invention that are described hereinafter.

Processor 82 may be any suitable processor and preferably is a microprocessor. Memory 86 is preferably a random access memory, such as a flash memory, and may also include one or more electrically alterable read only memories (EPROMS). Operating system 92, ice machine program 94 and other programs and data may be downloaded or uploaded from or to other computing tools or systems. This is an advantageous feature of the present invention that enables ice machine program 94, parts thereof or changes thereto and/or other data to be uploaded and/or downloaded by field personnel at the site of ice machine 50 or remotely via a network. This avoids the need for maintaining a large inventory of parts for making software changes and gives service personnel an electronic access to ice machine 50 for service and maintenance.

Referring to FIGS. 1 and 3, housing 54 includes a sidewall 60 and an internal wall 62. Evaporators 30 and ice cube deflector 19 are mounted between sidewall 60 and internal wall 62. Bin level sensors 34 include an optical signal transmitter 34A disposed on side wall 60 and an optical signal receiver 34B disposed on internal wall 62 in a zone 64 between evaporators 30 and ice cube deflector 19.

Electronic controller 10 controls bin sensors 10 to detect falling ice cubes during the harvest cycle and the condition in which ice cube bin 36 is full (Bin Full). When Bin Full is detected, electronic controller 10 interrupts the normal sequencing of freeze and harvest cycles until Bin Full is no longer detected.

Figure 5:
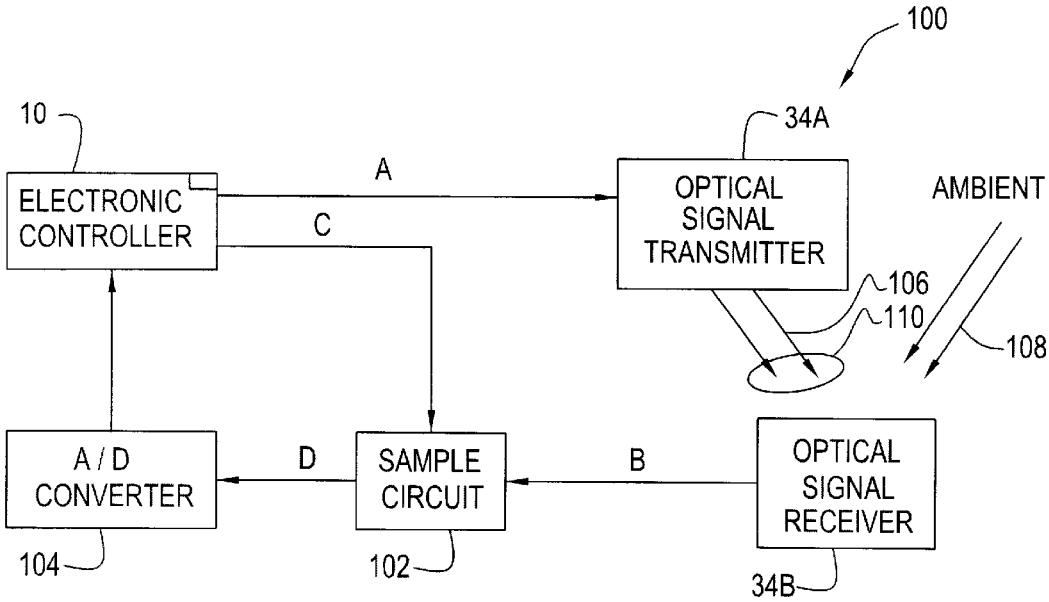
FIG. 5 is a block diagram of the optical detection circuit of the ice machine of FIG. 1.
Figure 6:
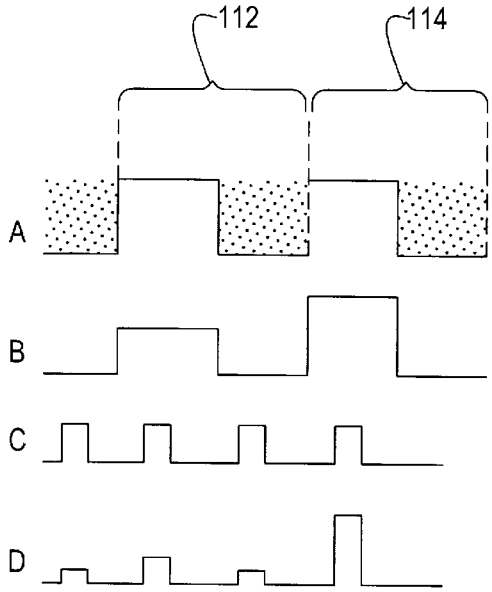
FIG. 6 is a waveform diagram of signals occurring at various point of the optical detection circuit of FIG. 5.

Referring to FIGS. 4 and 5, an ice cube detector 100 includes electronic controller 10, optical signal transmitter 34A, optical signal receiver 34B, a sample circuit 102 and an analog/digital (A/D) converter 104. Electronic controller 10 supplies a signal A, which, though shown as having a 50% duty cycle, could have a different desired duty cycle. Signal A drives optical signal transmitter 34A to produce an optical signal 106 having a waveform similar to that of signal A. Optical signal 106 is beamed to a field of vision 110 of optical signal receiver 34B. Optical signal 106 has cycle portions during which light is beamed (light cycle portions) that alternate with cycle portions during which no light is beamed (dark cycle portions). For example, the dark and light cycle portions are shown in FIG. 6 as the shaded and unshaded cycle portions of signal A, respectively. For the example of a 50% duty cycle, the cycle portions are half cycles. Optical signal receiver 34B also receives an ambient noise signal 108 due to ambient light conditions, mist, mineral accumulation and other conditions that produce optical noise.

If there is no ice cube within field of vision 110, the output signal B will have a relatively small amplitude as shown during the light half cycle of a cycle 112 of FIG. 6. On the other hand, if there is an ice cube in field of vision 110, output signal B will have a relatively large amplitude as shown by the light half cycle of a cycle 114 of FIG. 6. Electronic controller 10 also supplies a sample signal to sample circuit 102 at a rate of two sample signal pulses per cycle of signal A, with each sample signal pulse occurring in a different half cycle of signal A. Thus sample circuit 102 samples signal B during each half cycle thereof and provides an output signal D of samples to A/D converter 104. A/D converter 104 converts the signal samples of signal D to digital signals that are supplied to electronic controller 10.

Ice machine program 94 processes the signal samples supplied by A/D converter 104. According to one aspect of the invention, the digital signal samples are normalized to a range of values proportional to their magnitudes or voltages. For example, if the range is from 0 to 255, the minimum value is zero and the maximum value is 255. The normalized signal samples are processed to produce a plurality of difference signals. For the purpose of detecting falling ice cubes, each difference signal is derived as the difference between the normalized signal sample of consecutive light half cycles. The difference signals are then processed to determine if an ice cube has been detected. For the purpose of detecting a bin full condition, the difference signal is derived as the difference between the signal sample of a light half cycle (peak) and an adjacent dark half cycle (valley). The use of the difference signals eliminates variances due to manufacturing tolerances and to ambient conditions.

According to another aspect of the invention, controller 10 processes the difference signals to determine whether an ice cube is interrupting (blocking) optical signal 106. This procedure compares the difference signals to a predetermined threshold over an interval that embraces a plurality of cycles of signal A. If the difference signal samples penetrate the threshold a predetermined number of times during the interval, an ice cube is determined to be present. For example, if the predetermined threshold is 25 and if the signal samples resulting from consecutive peaks or light half cycles of signal A are 150 and 140, the difference signal value is 10 and the predetermined threshold is not penetrated. On the other hand, if the signal samples resulting from adjacent peaks of signal A are 150 and 120, the difference signal value is 30 and the predetermined threshold is penetrated. To qualify as a falling ice cube detection, there must be a predetermined number of threshold penetrations or hits per interval of cycles of signal A. For example, if the predetermined number is three, there must be three hits per interval to qualify as a falling ice cube.

Figure 7:
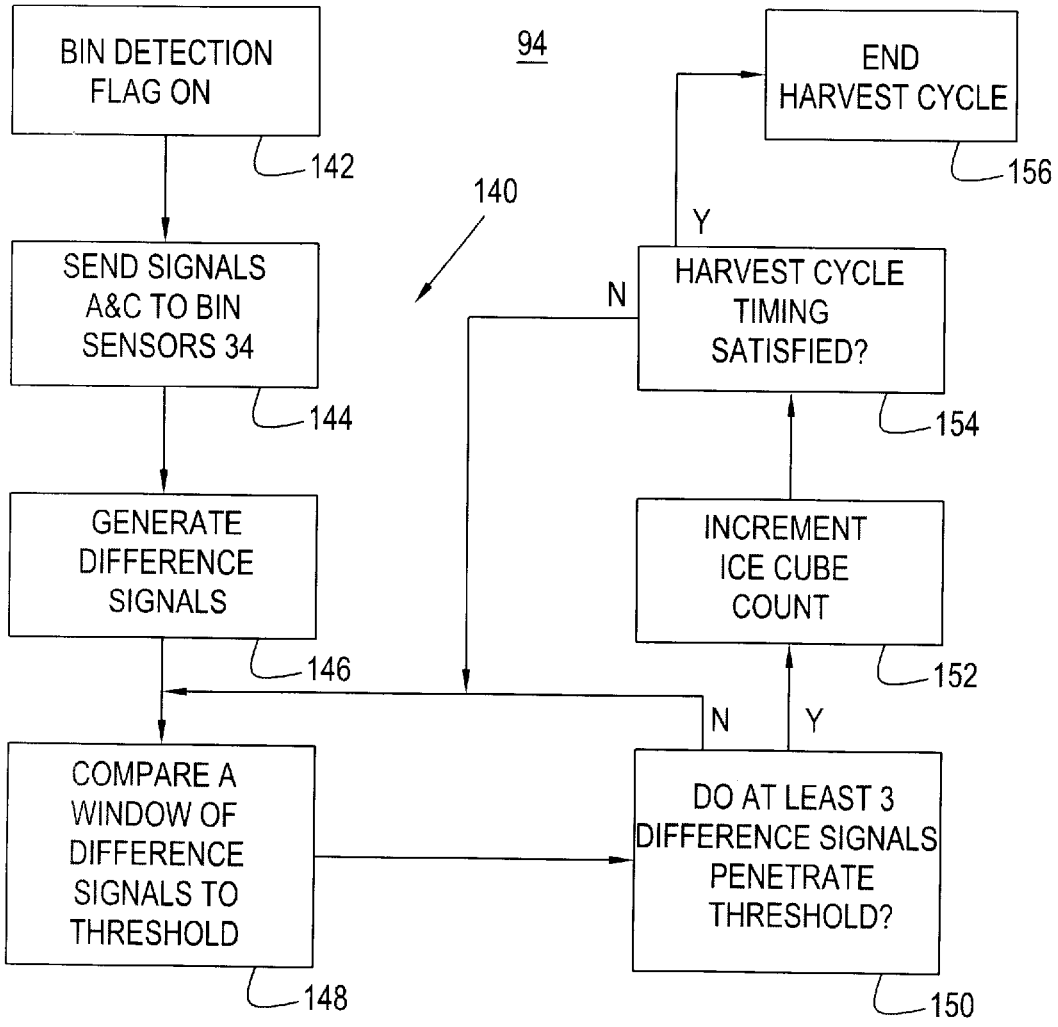

Referring to FIG. 7, ice machine program 94 includes an ice cube detection program 140. Step 142 determines when a bin detection flag is on. Step 144 supplies signals A and C (FIG. 5) to ice cube detector 100 (FIG. 4). Step 146 processes the digital signal samples returned by ice cube detector 100 to generate difference signals. Step 148 compares a window of difference signals to a predetermined threshold. Step 150 determines if at least a predetermined number (e.g., 3) of difference signals penetrate (e.g., dip below) the threshold. If not, step 148 is repeated for the next window of difference signals. If so, step 152 increments an ice cube count. Step 154 determines if the harvest cycle timer has been satisfied. If not, step 148 is repeated for the next window of difference signals. If so, step 156 ends the harvest cycle.

Program 94 includes other features to process the detected ice cubes, such as those described in U.S. Pat. Nos. 5,477,694 and 5,901,561 and/or other features.

Bin level sensors 34 are also used to determine if ice cube bin 36 is full. For this case, the difference signal values are derived from a difference between signal samples resulting from adjacent light and dark cycles or peaks and valleys of signal A. Assuming the same predetermined threshold of 25 and adjacent peak and valley values of 150 and 130, respectively, the difference signal does not dip below the predetermined threshold of 25. Therefore, the bin full condition is not detected. On the other hand, if the adjacent peak and valley values are 150 and 120, respectively, the difference value dips below the predetermined threshold of 25. Therefore, the bin full condition is detected and the harvest cycle is ended and the freeze and harvest cycles are suspended until subsequent processing determines that the bin full condition is no longer is detected.

Figure 8:
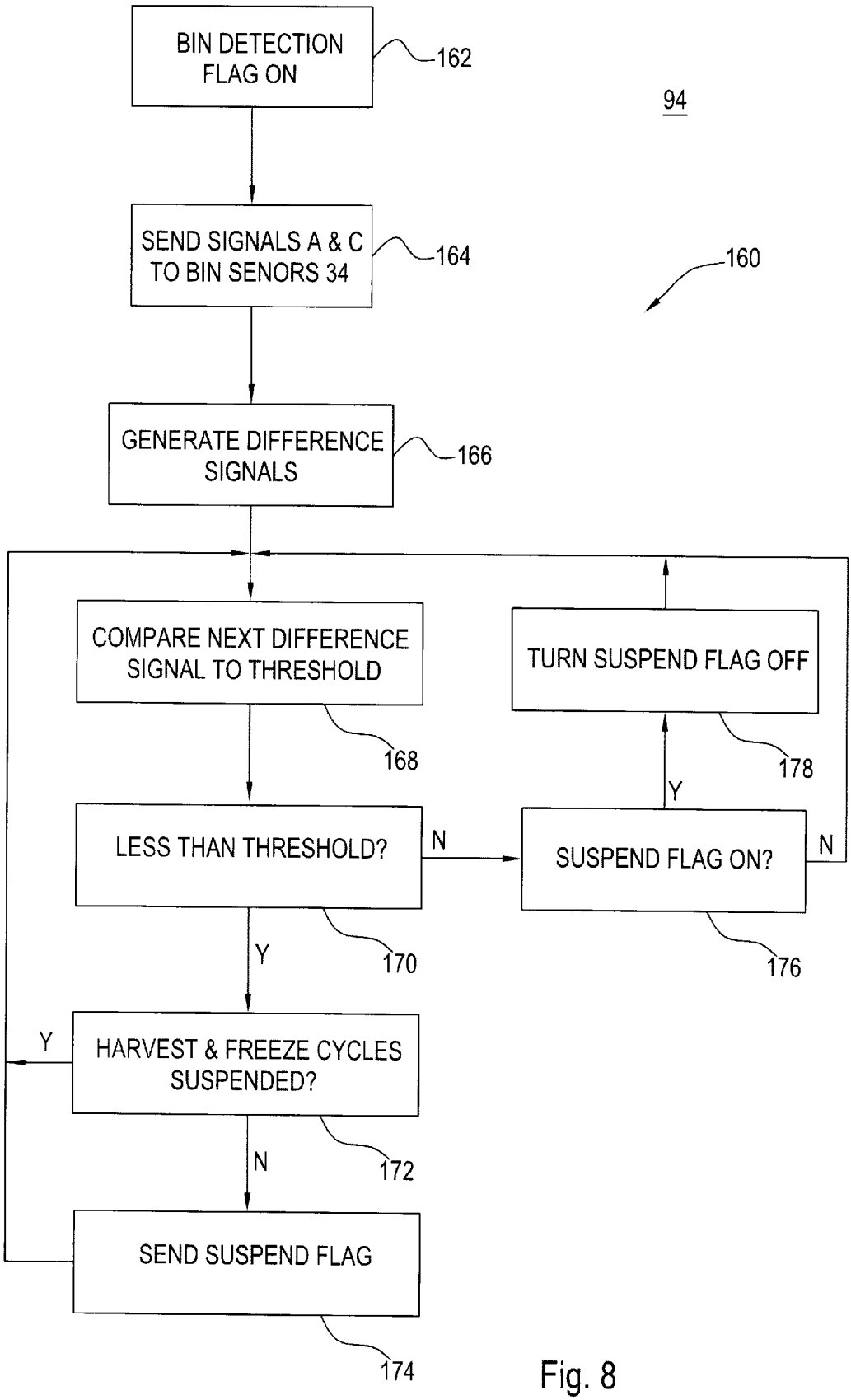
FIGS. 8–11 are flow diagrams of various features of the ice machine program of the electronic controller of FIG. 4.

Referring to FIG. 8, program 94 includes a bin full program 160. Step 162 determines that a bin detection flag is on. Step 164 supplies signals A and C (FIG. 5) to ice cube detector 100 (FIG. 4). Step 166 processes the digital signal samples returned by ice cube detector 100 to generate difference signals. Step 168 compares a next difference signal to the predetermined threshold. Step 170 determines if the next difference signal is less than the predetermined threshold. If yes, step 172 determines if the harvest and freeze cycles are suspended. If yes, steps 168 and 170 are repeated. If not, step 174 suspends or prevents any further freeze and harvest cycles and steps 168, 170 and 172 are repeated.

If step 170 determines that the difference signal is less than the threshold, step 176 determines if the suspend flag is on. If not, steps 168 and 170 are repeated. If yes, a change from a bin full to a bin not full condition has been detected and step 178 turns off the suspend harvest and freeze cycle flag.

According to another aspect of the invention, program 94 includes a feature of logging cycle counts and run time for the electrical loads of ice machine 50. The cycle counts include freeze cycles, harvest cycles, clean cycles and the like. The electrical loads include compressor 12, condenser fan motor 46, a harvest bypass valve, a liquid line solenoid, the hot gas valve, water pump 14 (the motor thereof), water fill valve 40 and electrical power to ice machine 50.

Figure 9:
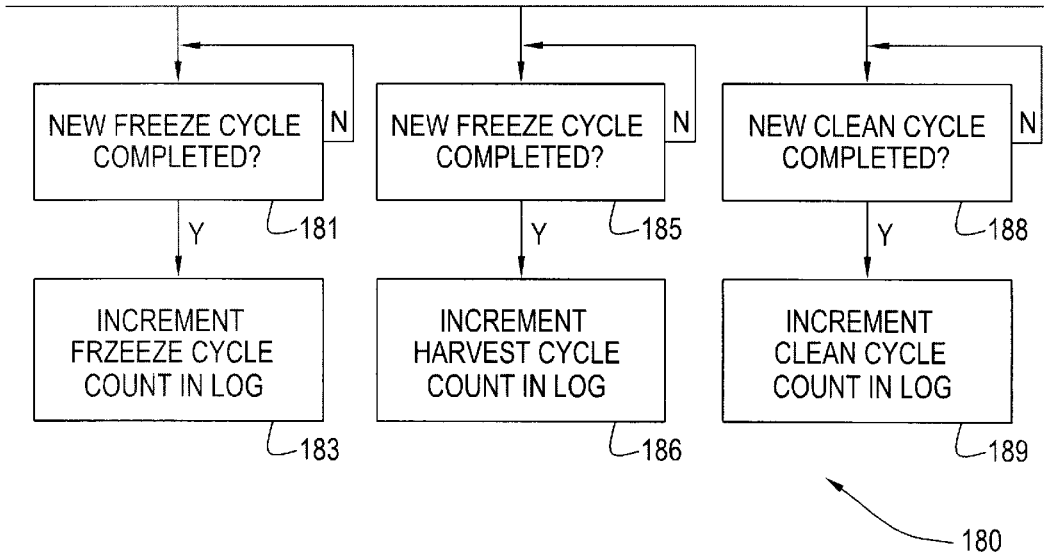

Referring to FIG. 9, ice machine program 94 includes a log program 180. Step 181 determines that a freeze cycle has been completed. If so, a freeze cycle count is incremented. Step 185 determines that a harvest cycle has been completed. If so, a harvest cycle count is incremented. Step 188 determines that a clean cycle has been completed. If so, a clean cycle count is incremented. The freeze count, harvest count and clean count are maintained in a log in memory 86, which is accessible via serial port 90 by external devices operated by field personnel at the site of the ice machine 50 or remotely therefrom via a network.

Figure 10:
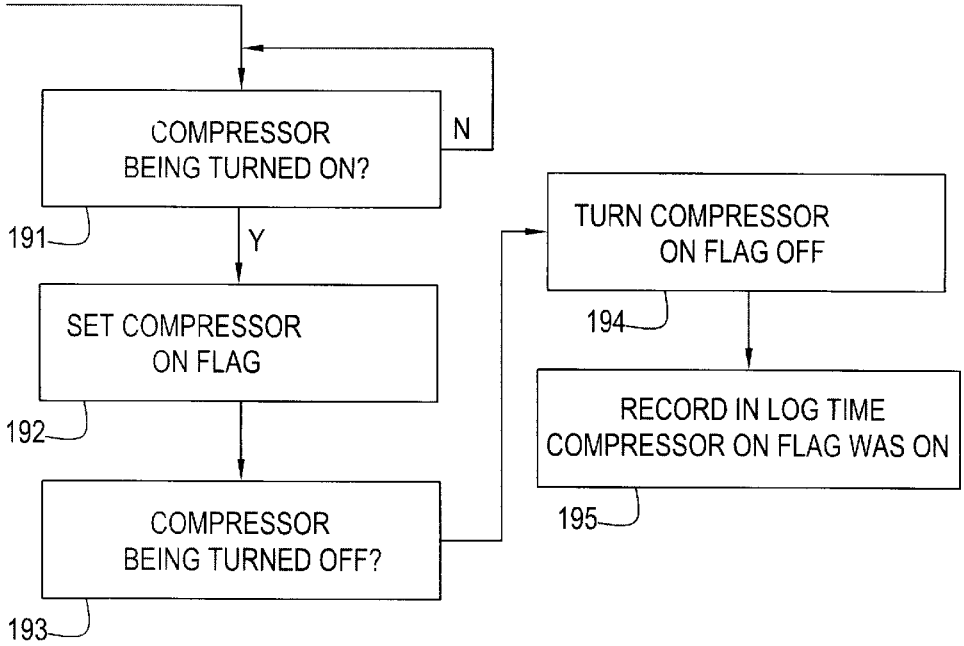

Referring to FIG. 10, log program 180 further processes a log for electrical load run times. An example is shown for logging run time of compressor 12, the runtime logging of other electrical loads being similar. Step 191 responds to compressor 12 being turned on. Step 192 then sets a compressor on flag. Step 195 detects that compressor 12 is being turned off. Step 194 turns the compressor on flag off. Step 195 records the time that the compressor on flag was on in the log. Again the log is maintained in memory 86 for access via serial port 90. These logs are valuable in determining root cause of failure and the actual usage pattern of ice machines 50 in different applications.

Figure 11:
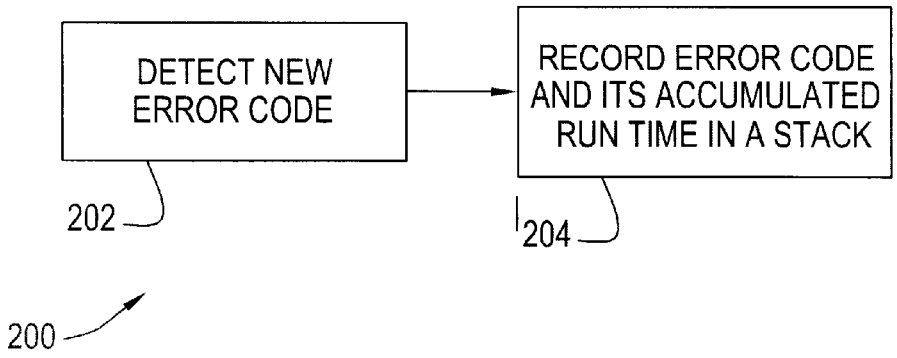

Referring to FIG. 11, ice machine program 94 also includes an error code program 200. Step 202 detects a new error code developed by diagnostic programs included in ice machine program 94. Step 204 records the detected error code and its accumulated run time in a stack in memory 86. The accumulated run time is the elapsed time since installation of ice machine 50.

Figure 12:
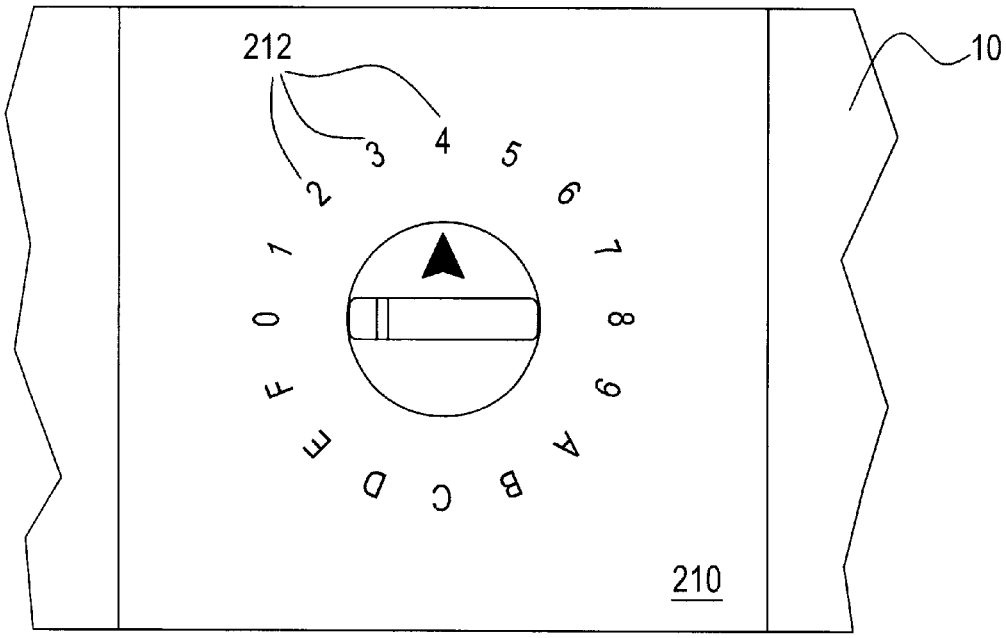
FIG. 12 is a partial view of the electronic controller of FIG. 4.

According to another aspect of the present invention, electronic controller 10 is a universal controller in that ice machine program 94 includes a plurality of versions for different models of ice machine 50. Referring to FIG. 12, a selector switch 210 is mounted on electronic controller 10. Selector switch 210 is manually operable to any one of a plurality of positions 212 to select a particular version of ice machine program 94.

Figure 13:
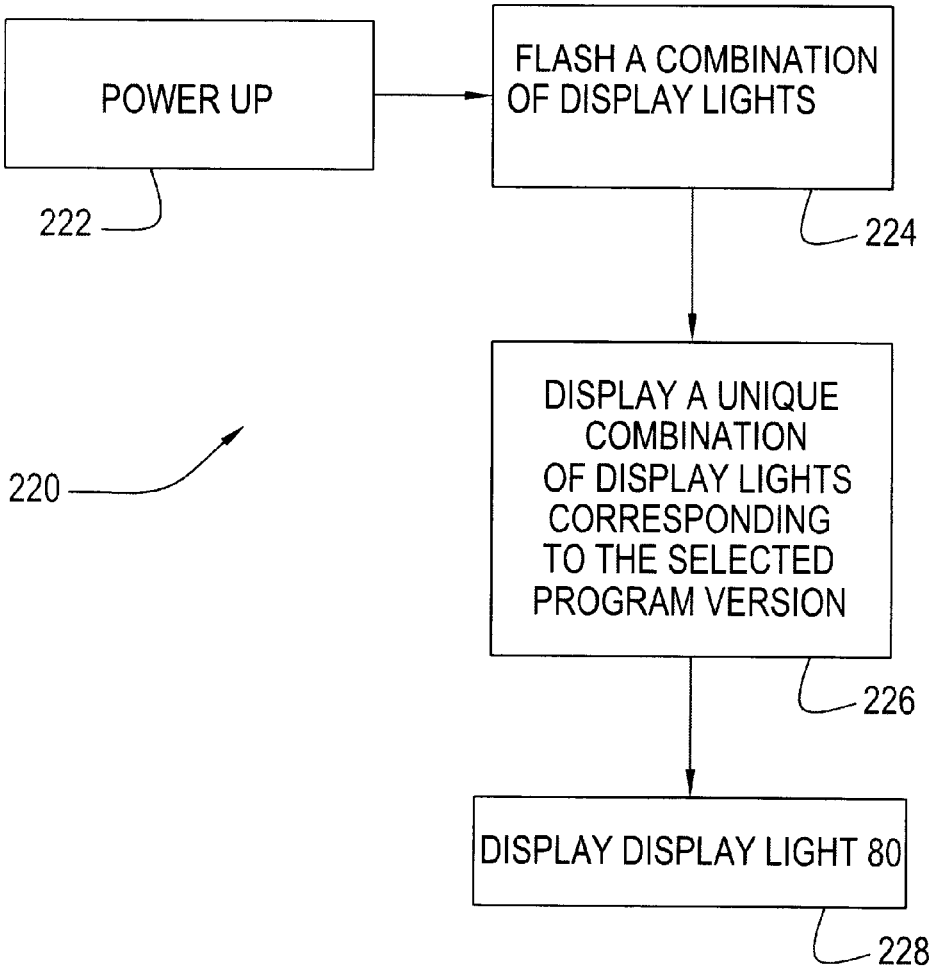
FIG. 13 is a flow diagram of another feature of the ice machine program of the electronic controller of FIG. 4.

Referring to FIG. 13, ice machine program 94 includes a display program 220 that allows verification that the proper version of ice machine program 94 for a current model of ice machine 50 has been selected. Step 222 detects that electrical power is being turned on. Step 224 flashes a combination of display lights 72, 74, 76, 78, 80, 82 and 84, for example all of them, a number of times, for example one time. Then step 226 displays a unique combination of display lights 72, 74, 76, 78 and 80 which corresponds to the selected program version. This display continues for a short time, say 20 seconds, during which the diagnostic buttons 82 and 84 flash. If the operator does not push any button during this time, display light 80 will be energized and display lights 82 and 84 will turn off. This signifies that ice machine is ready to make ice and awaits selection of freeze button 22.

If step 226 displays a wrong program code for the current model of ice machine 50, the operator can turn off the power and operate selector switch 10 to a correct setting. Steps 222, 224, 226 and 228 are then repeated.

Ice display program 220 also operates electronic controller 10 to display one or more recent error codes registered or logged for ice machine 50. The procedure is as follows for a design in which display of only the two most recent error codes is permitted:

1. Hold off button 25 in for longer than three seconds.
2. Hold off button 25 in again until display lights 74, 76, 78 and 80 are on.
3. Push and release harvest button 23.
4. Energize a unique combination of display lights 74, 76, 78 and 80 that corresponds to the most recent error code (if any).
5. Push and release harvest button 23 again.
6. Energize a unique combination of display lights that corresponds to the next most recent error code (if any) and also energize display light 72.
7. If no error code exists, do not energize any of display lights 74, 76, 78 and 80.
8. Pushing and releasing of harvest button 23 toggles the display back and forth between the most recent error code and the next most recent error code.
9. To exit from the display of error codes, do nothing for a predetermined time, e.g., 60 seconds, or push and release off button 25.

It will be apparent to those skilled in the art that other push button sequences of the same or different combinations may be used and that more than two recent code errors may be displayed. This procedure advantageously permits field personnel to quickly and visually determine causes of recent problems with ice machine 50.

The present invention having been thus described with particular reference to the preferred forms thereof, it will be obvious that various changes and modifications may be made therein without departing from the spirit and scope of the present invention as defined in the appended claims.

What is claimed is:

1. A method for controlling an ice machine having an optical detector that detects ice cubes when in a field of vision thereof, said method comprising:

(a) illuminating said optical detector with a periodic optical signal;

(b) providing a plurality of samples of an output signal of said optical detector; and (c) comparing a difference between at least a first one and a second one of said plurality of samples with a threshold to detect said ice cubes when in said field of vision.

2. The method of claim 1, further comprising:

(d) determining that one of said ice cubes is passing through said field of vision if said difference penetrates said threshold a predetermined number of times during an interval of said periodic optical signal that contains a plurality of cycles thereof.

3. The method of claim 1, wherein said at least first and second samples correspond to consecutive peaks of said periodic optical signal.

4. The method of claim 1, further comprising;

(e) determining that a bin of said ice machine is full of said ice cubes if said difference penetrates said threshold.

5. The method of claim 1, wherein said at least first and second samples correspond to an adjacent peak and valley of said periodic optical signal.

6. An ice machine comprising:

an ice machine system; and an electronic controller for controlling said ice machine system to make ice cubes; said electronic controller including a ice machine program that operates said ice machine system to perform operations that comprise:

(a) illuminating said optical detector with a periodic optical signal;

(b) providing a plurality of samples of an output signal of said optical detector; and (c) comparing a difference between at least a first one and a second one of said plurality of samples with a threshold to detect said ice cubes when in said field of vision.

7. The ice machine of claim 6, wherein said operations further comprise:

(d) determining that one of said ice cubes is passing through said field of vision if said difference penetrates said threshold a predetermined number of times during an interval of said periodic optical signal that contains a plurality of cycles thereof.

8. The ice machine of claim 6, wherein said at least first and second samples correspond to consecutive peaks of said periodic optical signal.

9. The ice machine of claim 6, wherein said operations further comprise:

(e) determining that a bin of said ice machine is full of said ice cubes if said difference penetrates said threshold.

10. The method of claim 9, wherein said at least first and second samples correspond to an adjacent peak and valley of said periodic optical signal.

* * * * *